US007234439B2

(12) United States Patent
Kikutani et al.

(10) Patent No.: US 7,234,439 B2
(45) Date of Patent: Jun. 26, 2007

(54) FUEL INJECTION SYSTEM EXECUTING OVERLAP INJECTION OPERATION

(75) Inventors: Takashi Kikutani, Ama-gun (JP); Hiroyuki Nishimura, Kariya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 204 days.

(21) Appl. No.: 11/103,473

(22) Filed: Apr. 12, 2005

(65) Prior Publication Data

US 2005/0229898 A1 Oct. 20, 2005

(30) Foreign Application Priority Data

Apr. 14, 2004 (JP) ..... 2004-119206

(51) Int. Cl.
*F02B 3/12* (2006.01)

(52) U.S. Cl. ..... 123/299; 361/154; 701/105

(58) Field of Classification Search ..... 123/299; 361/154; 701/105
See application file for complete search history.

(56) References Cited

FOREIGN PATENT DOCUMENTS

JP 7-71639 3/1995

*Primary Examiner*—Erick Solis
(74) *Attorney, Agent, or Firm*—Nixon & Vanderhye P.C.

(57) ABSTRACT

A control device executes an overlap injection operation, in which one of the plurality of injectors is energized first to inject fuel, and a next one of the plurality of injectors is energized to inject fuel after starting of the energization of the one of the plurality of injectors while the one of the plurality of injectors is still kept energized. The control device corrects an energization period of the next one of the injectors by lengthening the energization period of the next one of the injectors in comparison to a normal energization period of the next one of the injectors, which is set for a non-overlap injection operation of the next one of the plurality of injectors.

4 Claims, 5 Drawing Sheets

FUEL INJECTION SYSTEM EXECUTING OVERLAP INJECTION OPERATION

CROSS REFERENCE TO RELATED APPLICATION

This application is based on and incorporates herein by reference Japanese Patent Application No. 2004-119206 filed on Apr. 14, 2004.

BACKGROUND OF THE INVENTION

1. Field of the Invention

The present invention relates to a fuel injection system having a plurality of injectors, and particularly to a fuel injection system that executes an overlap injection operation, in which one of a plurality of injectors is energized first to inject fuel, and a next one of the injectors is energized after starting of the energization of the one of the injectors while the one of the injectors is still kept energized.

2. Description of Related Art

In one previously proposed fuel injection system, a large electric energy (high voltage) is stored in a charge capacitor. At the time of operating an injector, the electric energy, which has been stored in the charge capacitor, and electric energy, which is supplied from a constant-current circuit, are applied to a solenoid valve of the injector to improve response of the solenoid valve and thereby to improve the response of the injector (see, for example, Japanese Unexamined Patent Publication No. H07-71639).

It has been demanded to perform multiple injections (e.g., pilot injection m1, pre-injection m2, main injection m3 and after-injection m4, which are similar to those depicted in FIG. 2) per compression and expansion cycle of each cylinder to limit engine vibration and engine noise, to purify exhaust gas and to achieve high engine power and low fuel consumption at good balance.

Also, for the purpose of purifying the exhaust gas, it has been also demanded to perform one or more fuel injections (post-injection p1, which is similar to one depicted in FIG. 2) after combustion of the fuel in each corresponding cylinder.

With reference to FIG. 2, one of the multiple injections (e.g., the pilot injection m1) of one of the cylinders and the post injection p1 of another one of the cylinders may overlap with one another to perform an overlap injection operation.

In the overlap injection operation, as discussed above, one of the injectors (hereinafter referred to as an injector A or a former one of the overlapping injectors) is energized first to inject fuel, and a next one of the injectors (hereinafter, referred to as an injector B or a latter one of the overlapping injectors) is energized after starting of the energization of the one of injectors while the one of the injectors is still kept energized. As shown in FIG. 1A, it is conceivable to provide a plurality of charge capacitors in a charge circuit of an injector drive circuit. One of the charge capacitors supplies electric energy to the injector A, and another one of the charge capacitors supplies electric energy to the injector B. In this way, the high voltage is supplied to the injections A, B from the different charge capacitors, respectively.

A ground (GND) of the injector drive circuit is common to all of the injectors. Thus, the electric potential of the ground is increased right after application of the electric energy to the injector A. Thus, when the electric energy is supplied to the injector B right after the application of the electric energy to the injector A, the discharge current of the charge capacitor at the time of energizing the injector B is reduced. More specifically, the electric current supplied to the injector B is reduced.

When the discharge current of the charge capacitor is reduced at the time of energizing the injector B, the valve opening response of the injector B is reduced to reduce the accuracy of the injection amount in the injector B.

Due to the above described reason, the overlap injection operation has been avoided.

However, due to the diversification of fuel injection (e.g., the above multiple injections) and/or adaptation of the post processing system (e.g., the above post-injection), there is a strong demand for the overlap injection operation.

SUMMARY OF THE INVENTION

The present invention addresses the above disadvantage. Thus, it is an objective of the present invention to provide a fuel injection system, which minimizes deterioration in accuracy of an injection amount of a latter one of overlapping injectors at time of executing an overlap injection operation.

To achieve the objective of the present invention, there is provided a fuel injection system, which includes a plurality of injectors and a control device. The injectors are operated through energization thereof. The control device controls energization of each of the plurality of injectors to control an operational state of each of the plurality of injectors. The control device executes an overlap injection operation. In the overlap injection operation, one of the plurality of injectors is energized first to inject fuel, and a next one of the plurality of injectors is energized to inject fuel after starting of the energization of the one of the plurality of injectors while the one of the plurality of injectors is still kept energized. The control device includes an overlap correcting means for correcting an energization period of the next one of the plurality of injectors by lengthening the energization period of the next one of the plurality of injectors in comparison to a normal energization period of the next one of the plurality of injectors, which is set for a non-overlap injection operation of the next one of the plurality of injectors.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

A common rail type fuel injection system according to an embodiment of the present invention will be described with reference to FIGS. 1 to 5. First, a structure of the common rail type fuel injection system will be described with reference to FIG. 4.

The common rail type fuel injection system is a system, which injects fuel in a diesel engine (hereinafter, referred to as an engine) 1 and includes a common rail 2, injectors 3, a supply pump 4 and a control device 5.

Figure 4:
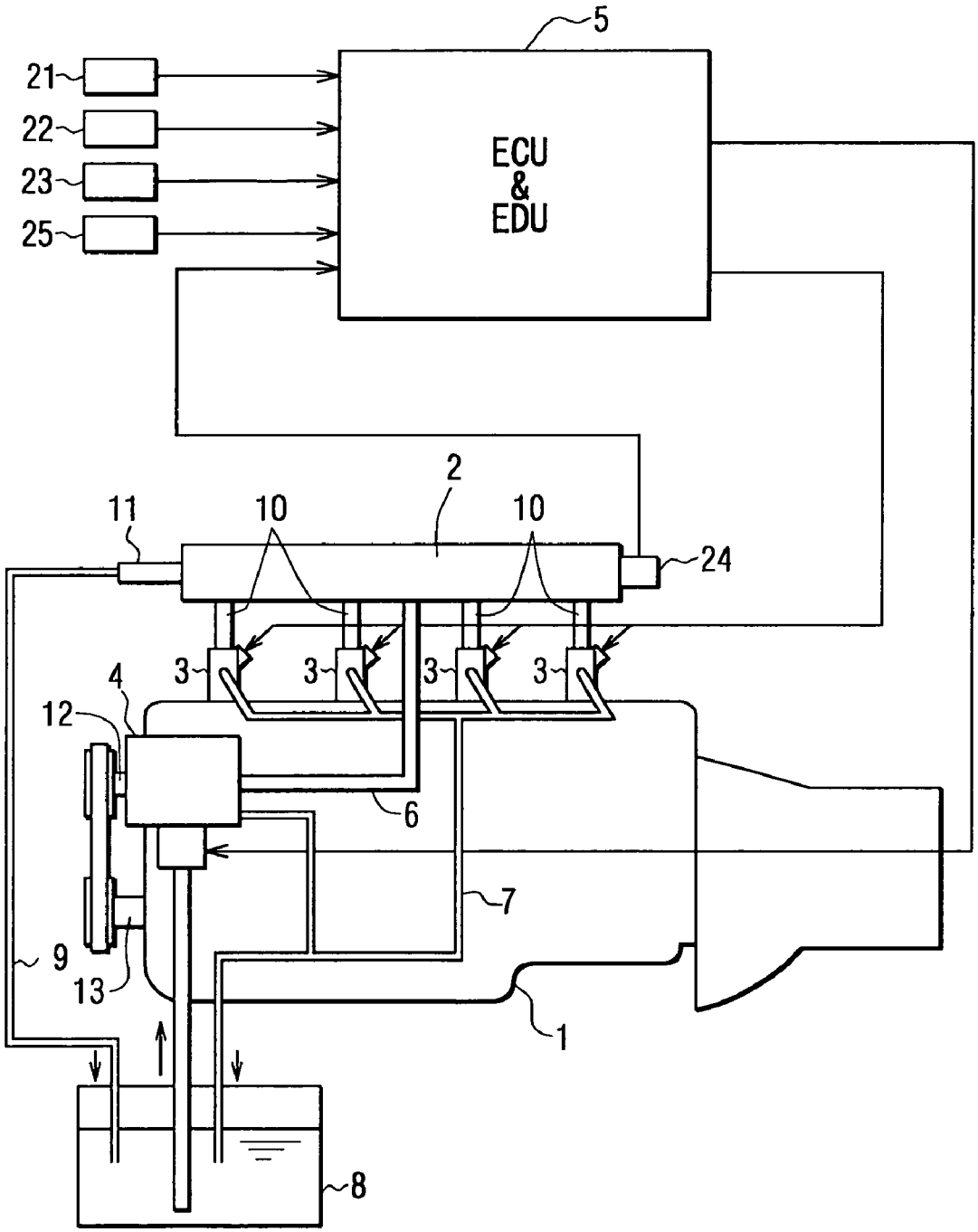
FIG. 4 is a schematic diagram showing the fuel injection system of a common rail type.

The engine 1 includes a plurality of cylinders, in each of which an intake stroke, a compression stroke, a combustion stroke and an exhaust stroke are continuously made during the operation of the engine 1. FIG. 4 depicts a four cylinder engine as an example of the engine 1. However, it should be noted that any other type of engine having multiple cylinders besides the four cylinders may be used in place of the four cylinder engine.

The common rail 2 is a pressure accumulator, which accumulates high pressure fuel to be supplied to the injectors 3. The common rail 2 is connected to a discharge outlet of the supply pump 4, which pumps high pressure fuel, through a fuel pipe line (a high pressure fuel flow passage) 6 to accumulate a common rail pressure that corresponds to an injection pressure for injecting fuel.

Leaked fuel, which is leaked from the injectors 3, is returned to a fuel tank 8 through a leak pipe line (fuel return passage) 7.

A pressure limiter 11 is installed to a relief pipe line (fuel return passage) 9, which extends from the common rail 2 to the fuel tank 8. The pressure limiter 11 is a safety valve. Specifically, when the fuel pressure in the common rail 2 exceeds a preset limit pressure, the pressure limiter 11 opens to limit the fuel pressure in the common rail 2 to be equal to or less than the preset limit pressure.

The injectors 3 are provided to the cylinders, respectively, of the engine 1 to inject the fuel into the corresponding cylinder. Each injector 3 is connected to a downstream end of a corresponding high pressure fuel flow passage 10, which branches from the common rail 2. Each injector 3 injects fuel, which is accumulated in the common rail 2, into the corresponding cylinder.

Figure 5:
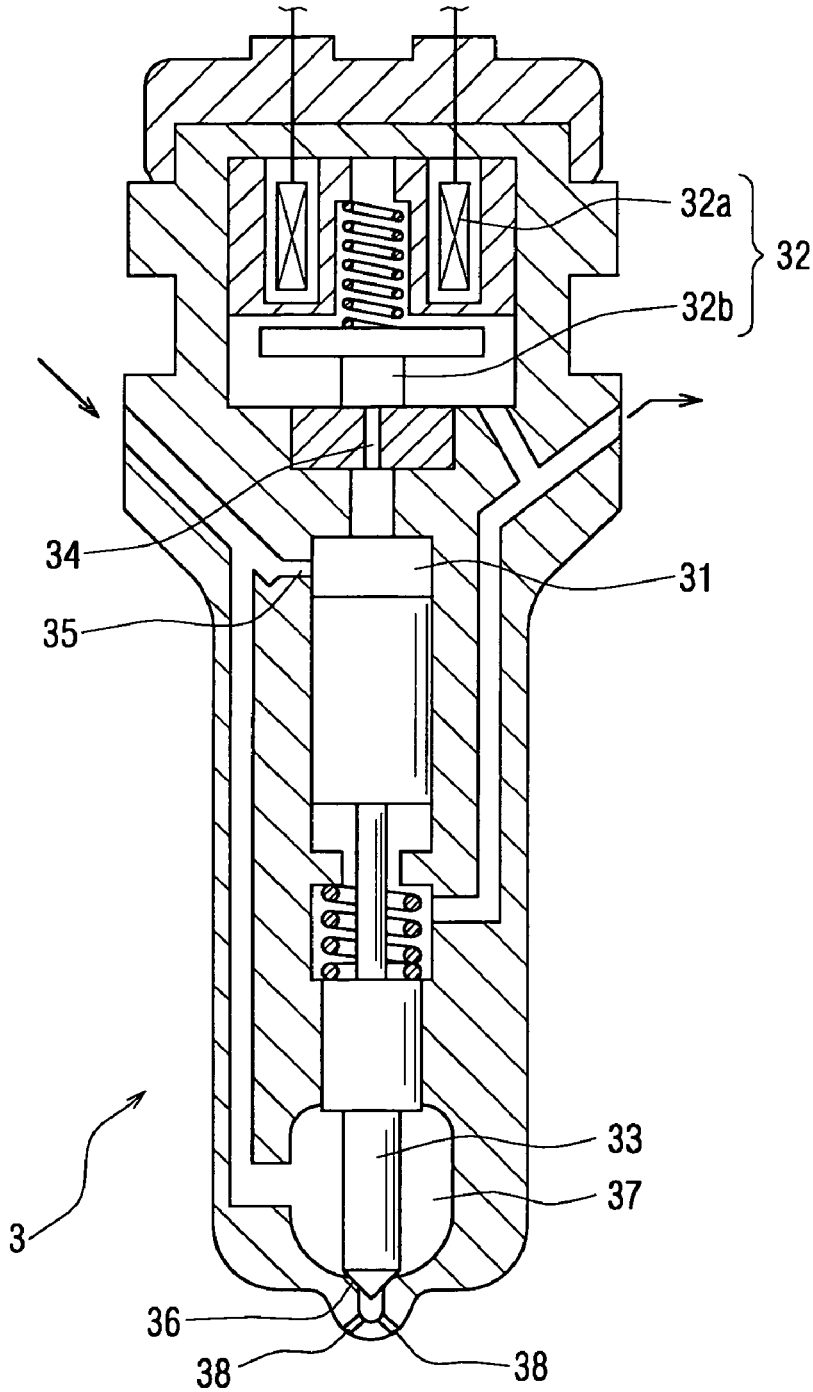
FIG. 5 is a schematic cross sectional view of an injector of the fuel injection system of the embodiment.

One specific example of the injector 3 will be described with reference to FIG. 5.

The injector 3 controls a pressure of a control chamber (a back-pressure chamber) 31 through a solenoid valve 32 and drives a needle (a valve body) 33 by the pressure of the control chamber 31. The solenoid valve 32 includes a solenoid 32*a* and a valve (slider) 32*b*.

When an injection signal (a pulse signal) is supplied to the solenoid 32*a* of the solenoid valve 32, lifting of the valve 32*b* is initiated. Then, an outlet orifice 34 is opened, and the pressure of the control chamber 31, which has been depressurized by an inlet orifice 35, begins to decrease.

When the pressure of the control chamber 31 become equal to or less the valve opening pressure, the needle 33 begins to move upwardly. When the needle 33 is lifted away from a nozzle seat 36, a nozzle chamber 37 is communicated to injection holes 38. Thus, the high pressure fuel, which is supplied to the nozzle chamber 37, is injected through the injection holes 38.

When the injection signal (the pulse signal), which is supplied to the solenoid 32*a* of the solenoid valve 32, is stopped, the valve 32*b* starts its movement toward the outlet orifice 34. When the valve 32*b* closes the outlet orifice 34, the pressure of the control chamber 31 begins to increase. When the pressure of the control chamber 31 becomes equal to or greater than the valve opening pressure, the needle valve 33 begins to move toward the nozzle seat 36.

When the needle 33 moves toward the nozzle seat 36 and seats against the nozzle seat 36, the communication between the nozzle chamber 37 and the injection holes 38 is disconnected. Thus, the fuel injection from the injection holes 38 stops.

The supply pump 4 is a fuel pump, which pumps fuel to the common rail 2. The supply pump 4 includes a feed pump and a high pressure pump. The feed pump draws fuel from the fuel tank 8 and supplies the drawn fuel to the supply pump 4. The high pressure pump compresses and supplies the drawn fuel, which is drawn by the feed pump. The feed pump and the high pressure pump are driven by a common cam shaft 12. AS shown in FIG. 4, the cam shaft 12 is rotated by, for example, a crank shaft 13 of the engine 1.

Furthermore, a metering inlet valve (not shown) is provided in the supply pump 4 to adjust the rate of fuel flow drawn into the high pressure pump. When the metering inlet valve is adjusted by the control device 5, the common rail pressure is adjusted.

The control device 5 includes an electric control unit (ECU) and an electric drive unit (EDU). The ECU performs various arithmetic calculations and outputs command signals for controlling the operation of the engine. The EDU includes an injector drive circuit and a pump drive circuit. In FIG. 4, the ECU and the EDU are provided in the single control device 5. However, the ECU and the EDU can be provided separately to form the control device or a control device assembly 5.

The ECU is a microcomputer having a known structure, which includes a CPU, a storage device (a memory, such as a ROM, a standby RAM, an EEPROM or a RAM), an input circuit, an output circuit and a power supply circuit. The CPU performs control arithmetic processes. The storage device stores various programs and data. The ECU performs various arithmetic calculations based on sensor signals (signals, which correspond to engine parameters, an operational state of an occupant and/or an operational state of the engine 1).

With reference to FIG. 4, the sensors, which are connected to the ECU, include an accelerator sensor 21, a rotational speed sensor 22, a coolant temperature sensor 23, a common rail pressure sensor 24 and other sensor(s) 25. The accelerator sensor 21 senses an opening degree of an accelerator. The rotational speed sensor 22 senses a rotational speed of the engine 1. The coolant temperature sensor 23 senses the coolant temperature of the engine 1. The common rail pressure sensor 24 sensor senses the common rail pressure.

A main feature of the injector drive circuit of the EDU will be described with reference to FIG. 1A.

The injector drive circuit of the present embodiment includes a charge circuit 41, a constant-current circuit 42, cylinder switches 43. The charge circuit 41 accumulates high electric energy to be supplied to the injectors 3. The constant-current circuit 42 applies the constant current to the injectors 3. The cylinder switches 43 are provided to select the injectors 3 for performing the fuel injection.

The charge circuit 41 includes a booster circuit 45 and charge capacitors 44. The booster circuit 45 generates the high voltage by boosting the battery voltage. Each charge capacitor 44 accumulates the high voltage, which is boosted by the booster circuit 45. The control device 5 is provided to monitor the charged voltage of the charge capacitors 44 (a monitor circuit being not depicted). When the charged voltage of the charge capacitors 44 becomes equal to or less than a predetermined value (a predetermined full charge voltage), the control device 5 drives the booster circuit 45 to make the voltage of the charge capacitors 44 to coincide with the predetermined value, so that the charged voltage of the charge capacitors 44 is increased to the predetermined value.

The constant-current circuit 42 may be a regulator circuit, which generates a predetermined electric current value. The constant-current circuit 42 may alternatively be a circuit, which is directly connected to the vehicle battery.

An injector control operation of the present embodiment will be described.

Figure 2:
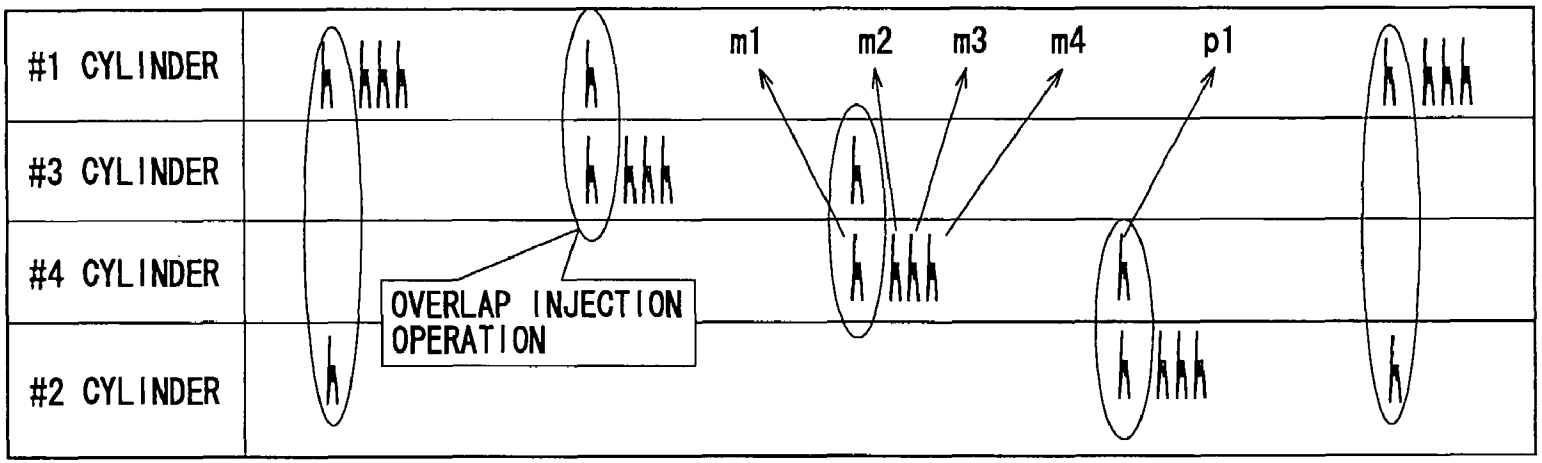
FIG. 2 is a time chart of drive current waveforms of all of four injectors in four cylinders for describing the overlap injection operation of the embodiment.

The common rail type fuel injection system of the present embodiment performs multiple injections per a compression and expansion cycle to limit the engine vibration and engine noise, to purify the exhaust gas and to achieve the high engine power and the low fuel consumption at good balance. As shown in FIG. 2, the multiple injections include, for example, a pilot injection m1, a pre-injection m2, a main injection m3 and an after-injection m4.

Furthermore, the common rail type fuel injection system of the present embodiment performs one or more injections (e.g., a post-injection p1 of FIG. 2) after combustion of the fuel based on the operational state of the engine 1 to purify the exhaust gas.

The ECU of the control device 5 performs the drive control operation of each respective injector 3 per injection based on the program (e.g., a corresponding map) stored in the ROM and also based on the engine parameters stored in the RAM.

The ECU of the control device 5 has an injection timing computing function and an injection period computing function as part of the program of the drive control operation.

The injection timing computing function is a control program, which obtains a target injection timing based on the current operational state and also obtains a commanded injection timing for initiating the fuel injection at the target injection timing. Then, this program causes generation of an injection start signal (specifically, starting of an ON-state of the injection signal) at the commanded injection timing in the EDU.

The injection period computing function is a control program, which obtains a target injection amount and also obtains a commanded injection period for achieving the target injection amount. Then, this program causes generation of an injection continuation signal (specifically, continuing of the ON-state of the injection signal) for maintaining continuous injection throughout the commanded injection period.

The EDU of the control device 5 maintains an ON-state of the corresponding constant current switch 46 of the constant current circuit 42 and performs high speed switching of the corresponding cylinder switch 43 arranged in the injector circuit throughout the period of the injection signal(s) of the ECU (the injection start signal indicating the start of the ON-state of the injection signal and the injection continuation signal indicating the continuation period of the ON-state of the injection signal).

When the injection signal for driving the injector 3 of the predetermined cylinder is supplied from the ECU to the EDU, the corresponding cylinder switch 43 of the predetermined cylinder is switched at the high speed. Then, the large electric energy (high voltage), which has been accumulated in the corresponding charge capacitor 44, is supplied to the corresponding solenoid valve 32. As a result, the corresponding injector 3 initiates the injection at the high response speed. Thereafter, when the peak of the drive electric current reaches the predetermined current value, a disconnecting switch 47, which is connected to the injector 3 of the predetermined cylinder, is turned off to disconnect the charge capacitor 44 from the injector 3. Then, the constant current is supplied from the constant current circuit 42 to the solenoid valve 32, so that an opened valve state of the injector 3 is maintained throughout the period of supplying the injection signal.

In the present embodiment, as discussed above, the multiple injections and the post-injection are performed. Thus, depending on the rotational speed of the engine 1, one (e.g., the pilot injection m1) of the multiple injections of one of the cylinders may overlap with, i.e., may be performed simultaneously with the post-injection p1 of another one of the cylinders to perform the overlap injection operation, as indicated in FIG. 2.

Figure 1A:
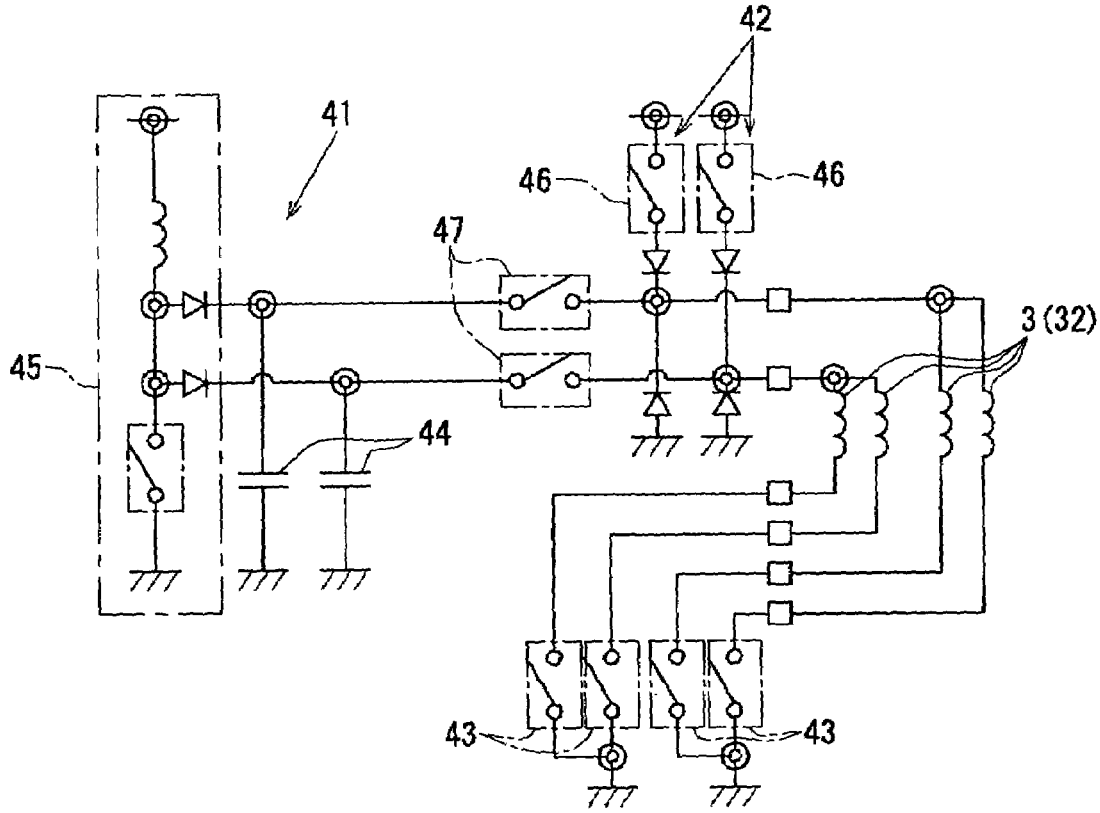
FIG. 1A is a circuit diagram showing an injector drive circuit of a fuel injection system according to an embodiment of the present invention.

In view of the above point, the injector drive circuit includes the multiple charge capacitors 44 (in the present embodiment, the two charge capacitors 44), as shown in FIG. 1A, to apply the high voltage to the injectors (specifically, the solenoid valves 32), which perform the overlap injection operation. In this way, the constant current is applied from the charge capacitors 44 to the injectors (specifically, the solenoid valves 32), respectively, which perform the overlap injection operation.

Specifically, in the engine 1 of this embodiment, the combustion (injection of the corresponding injector 3) is performed in an order of the first cylinder #1, the third cylinder #3, the fourth cylinders #4 and the second cylinder #2, as shown in FIG. 2.

Thus, in order to enable application of the high voltage to the respective injectors 3, which perform the overlap injection operation, the first cylinder #1 and the fourth cylinder #4 are connectable to one of the charge capacitors 44, and the second cylinder #2 and the third cylinder #3 are connectable to the other one of the charge capacitors 44.

The overlap injection operation is performed in the following manner. That is, one (injector A) of the injectors (a former one of the overlapping injectors) is energized first to inject fuel, and a next one (injector B) of the injectors (a latter one of the overlapping injectors) is energized to inject fuel after starting of the energization of the one of the injectors while the one of the injectors is still kept energized. The ground (GND) of the injector drive circuit is a common ground. Thus, the electrical potential of the ground increases right after the application of the electric energy to the injector A.

Therefore, in the state where the electrical potential of the ground is increased due to the start of the energization of the injector A, when the cylinder switch 43 of the injector B is turned on, and the charge capacitor 44 is connected to the injector B, the discharge current of the charge capacitor 44, which flows in the injector B, is reduced. In this way, the valve opening response of the injector B is deteriorated, and the accuracy of the injection amount in the injector B and the accuracy of the energization start timing of the injector B are disadvantageously decreased.

Figure 1B:
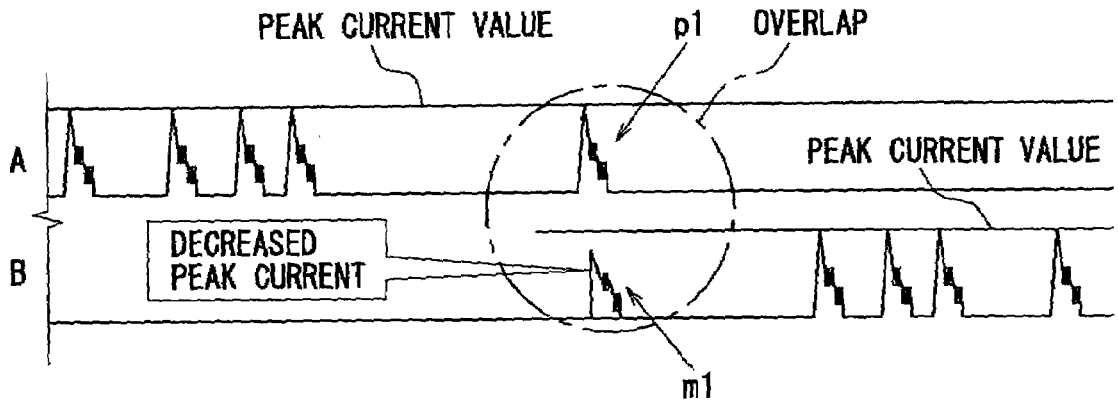
FIG. 1B is a time chart of drive current waveforms of two injectors of the fuel injection system for describing an overlap injection operation of the embodiment.

One specific example will be described. As shown in FIG. 1B, when the pilot injection m1 of the other cylinder (the energization of the injector B) overlaps the post-injection p1 of the one cylinder (the energization of the injector A), the peak current of the pilot injection m1 is reduced to cause deterioration of the accuracy of the injection amount of the pilot injection m1 and the accuracy of the injection start timing of the pilot injection m1.

In order to address the above disadvantages, an overlap correcting means is provided in the injection period computing function of the present embodiment. The overlap correcting means is for correcting the energization period of the injector B by lengthening the energization period (an ON-state period of the injection signal) of the injector B in comparison to a normal energization period of the injector B, which is set for the non-overlap injection operation of the injector B where there is no overlapping of injections of the cylinders.

The overlap correcting means of the present embodiment computes an energization start interval between the energization start timing (the timing obtained by the injection timing computing function) of the injector A and the energization start timing (the timing obtained by the injection timing computing function) of the injector B. Then, based on the energization start interval, the overlap correcting means computes a reduction in the discharge current (i.e., a reduced amount of discharge current), which flows in the injector B, through use of the corresponding map or the corresponding mathematical equation. Thereafter, the overlap correcting means computes a change in the injection amount through use of the corresponding map or the corresponding mathematical equation based on the reduction in the discharge current and the injection pressure. Then, the overlap correcting means computes a correction period for compensating the change in the injection amount based on the change in the injection amount and the injection pressure. Thereafter, the overlap correcting means determines the energization period of the injector B by adding the correction period to the normal energization period of the injector B in the non-overlap injection operation.

When the energization start timing of the injector B is corrected, the current value of the injector B (the discharge current of the charge capacitor 44) is changed to a different value. Thus, the energization start timing of the injector B (the generation timing of the injection signal) should not be corrected.

Figure 3:
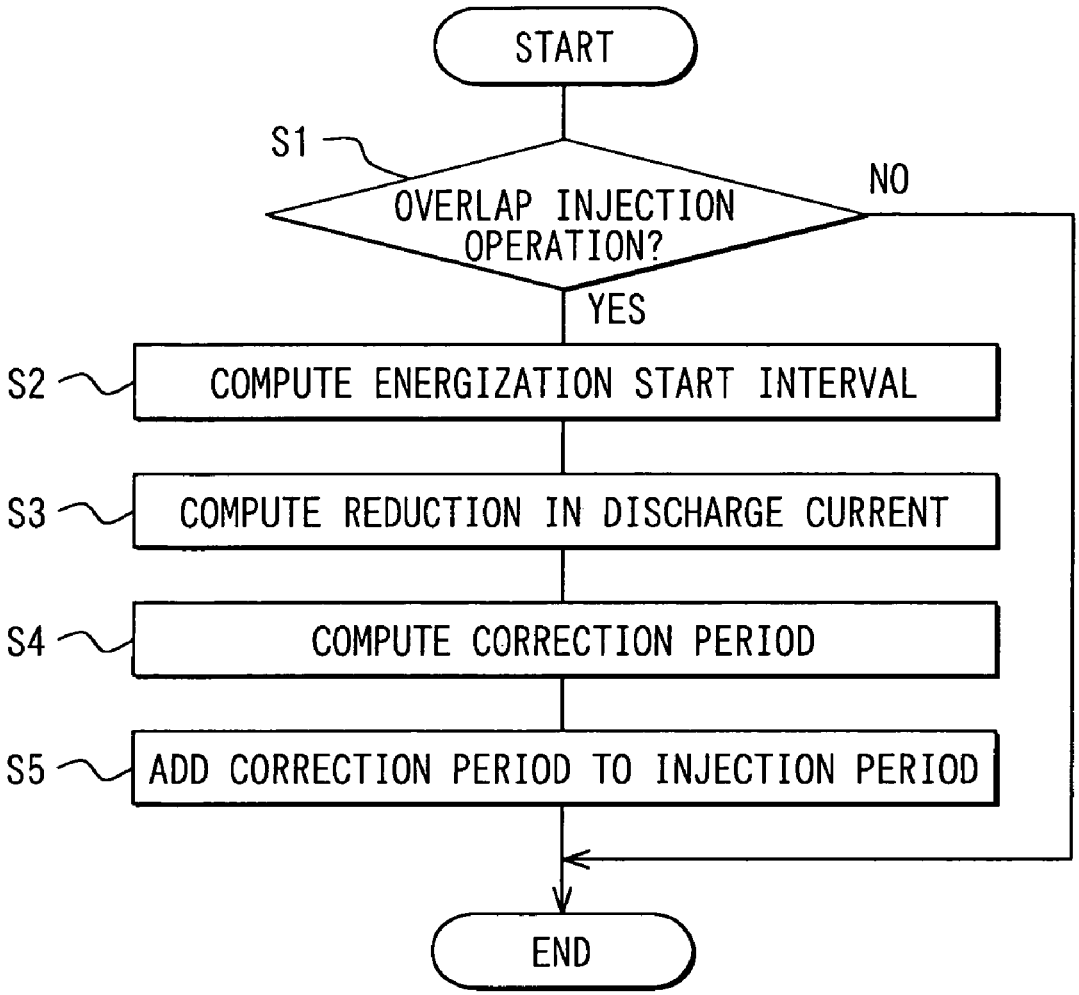
FIG. 3 is a flow chart showing an exemplary control operation of an overlap correcting means of the embodiment.

An exemplary control operation of the overlap correcting means will be described with reference to FIG. 3.

Upon completion of the injection period computing routine for computing the normal injection period of the injector B in the non-overlap injection operation, an overlap correcting routine is initiated.

First, it is determined whether the overlap injection operation will be performed (step S1). That is, it is determined whether the energization of the latter one of the injectors 3 will be started during the energization of the former one of the injectors 3.

When the result of the determination at step S1 is NO, the overlap correcting routine is terminated.

In contrast, when the result of the determination at step S1 is YES, the energization start interval between the energization start timing of the injector A and the energization start timing of the injector B is computed (step S2).

Next, the reduction in the discharge current (i.e., the reduced amount of discharge current), which flows in the injector B, is computed using the corresponding map or the corresponding equation based on the energization start interval obtained at step S2 (step S3).

Thereafter, the change in the injection amount (the reduction in the injection amount) is computed using the corresponding map or the corresponding equation based on the reduction in the discharge current obtained at step S3 and the injection pressure. Then, the correction period for compensating the change in the injection amount is computed using the corresponding map or the corresponding equation based on the change (the reduction) in the injection amount and the injection pressure (step S4).

Next, the correction period obtained at step S4 is added to the normal energization period (the normal injection period) of the injector B of the non-overlap injection operation (the energization period obtained in the injection period computing routine) to determine the corresponding energization period of the injector B (step S5). Thereafter, the current routine ends.

The above step S4 may be simplified in such a manner that the correction period for compensating the change in the injection amount (the reduction in the injection amount) is directly computed using the corresponding map or the corresponding equation based on the reduction in the discharge current and the injection pressure.

Furthermore, the above steps S3, S4 may be simplified in such a manner that the correction period for compensating the change (the reduction) in the injection amount is directly computed using the corresponding map or the corresponding equation based on the energization start interval and the injection pressure.

The present embodiment provides the following advantages.

The fuel injection system of the present embodiment corrects the energization period of the injector B by lengthening the energization period of the injector B to compensate the reduction in the electric current of the injector B even when the electric current of the injector B (discharge current of the charge capacitor 44) is reduced because of the increase in the electric potential of the ground at the time of starting the energization of the injector B caused by the energization of the injector A in the overlap injection operation.

More specifically, as shown in FIG. 1B, when the post injection p1 (the energization of the injector A) is overlapped with the pilot injection m1 of the other cylinder (the energization of the injector B), the peak electric current of the pilot injection m1 is reduced. However, the energization period of the injector B, which performs the pilot injection m1, is corrected by lengthening the energization period of the injector B to compensate the reduction in the peak electric current of the pilot injection m1.

As discussed above, even when the overlap injection operation is performed, the energization period of the injector B is lengthened to compensate the reduction in the electric current of the injector B. Thus, the reduction in the injection amount of the injector B can be limited. Particularly, in the above embodiment, the reduction in the electric current of the injector B is estimated based on the energization start interval between the energization start timing of the injector A and the energization start timing of the injector B. Then, the energization period of the injector B is corrected based on the estimated reduction in the electric current of the injector B. Thus, the reduction in the accuracy of the injection amount of the injector B in the overlap injection operation can be minimized.

The above embodiment can be modified as follows.

In the above embodiment, the case where the pilot injection m1 and the post injection p1 are overlapped is described as the exemplary case. However, it should be noted that the present invention is also applicable to another overlap injection operation, in which a different set of injections is used.

In the above embodiment, the injectors A, B receive the electric energy from the different electric energy applying means (the two charge capacitors 44) at the time of starting the energization of the injectors A, B. Alternatively, the injectors A, B may receive the electric energy from a common electric energy applying means (e.g., a single charge capacitor 44) at the time of starting the energization of the injectors A, B.

In the above embodiment, there is described the injector 3, in which the pressure of the control chamber 31 is controlled by the solenoid valve 32 to drive the needle 33 through use of the change in the pressure of the control chamber 31. Alternatively, there may be used an injector that has an actuator (e.g., a solenoid actuator, an actuator having a magnetostrictor, or an actuator having a piezoelectric element), which directly drives the needle (the valve body) 33.

In the above embodiment, the present invention is implemented in the common rail type fuel injection system. Alternatively, the present invention may be applied to a fuel injection system, which does not use the common rail. More specifically, the present invention may be applied to a fuel injection system used in another type of engine, such as a gasoline engine, other than the diesel engine.

Additional advantages and modifications will readily occur to those skilled in the art. The invention in its broader terms is therefore not limited to the specific details, representative apparatus, and illustrative examples shown and described.

What is claimed is:

1. A fuel injection system comprising:

a plurality of injectors, which are operated through energization thereof; and a control device, which controls energization of each of the plurality of injectors to control an operational state of each of the plurality of injectors, wherein:

the control device executes an overlap injection operation, in which one of the plurality of injectors is energized first to inject fuel, and a next one of the plurality of injectors is energized to inject fuel after starting of the energization of the one of the plurality of injectors while the one of the plurality of injectors is still kept energized; and the control device includes an overlap correcting means for correcting an energization period of the next one of the plurality of injectors by lengthening the energization period of the next one of the plurality of injectors in comparison to a normal energization period of the next one of the plurality of injectors, which is set for a non-overlap injection operation of the next one of the plurality of injectors.

2. The fuel injection system according to claim 1, wherein the overlap correcting means of the control device corrects the energization period of the next one of the plurality of injectors based on an energization start interval between an energization start timing of the one of the plurality of injectors and an energization start timing of the next one of the plurality of injectors.

3. The fuel injection system according to claim 1, further comprising a plurality of charge capacitors, each of which stores electric energy, wherein the plurality of charge capacitors includes:

a first charge capacitor, which supplies electric energy to the one of the plurality of injectors; and a second charge capacitor, which is different from the first charge capacitor and supplies electric energy to the next one of the plurality of injectors.

4. The injection system according to claim 1, wherein:

the energization of the one of the plurality of injectors is for performing one of pilot injection and post-injection in one of a plurality of cylinders of an internal combustion engine; and the energization of the next one of the plurality of injectors is for performing one of pilot injection and post-injection in another one of the plurality of cylinders of the internal combustion engine.

* * * * *